US010906068B2

(12) United States Patent
De Sousa et al.

(10) Patent No.: US 10,906,068 B2
(45) Date of Patent: Feb. 2, 2021

(54) MAIL SORTING INSTALLATION WITH A TRAY CONVEYOR HAVING A RETRACTABLE EDGE AND ITS TRAY-MANIPULATING SHUTTLE ROBOT

(71) Applicant: SOLYSTIC, Bagneux (FR)

(72) Inventors: Olivier De Sousa, Montmeyran (FR); Fabrice Eyraud, Portes les Valence (FR)

(73) Assignee: SOLYSTIC

( * ) Notice: Subject to any disclaimer, the term of this patent is extended or adjusted under 35 U.S.C. 154(b) by 174 days.

(21) Appl. No.: 16/373,966

(22) Filed: Apr. 3, 2019

(65) Prior Publication Data

US 2019/0308219 A1 Oct. 10, 2019

(30) Foreign Application Priority Data

Apr. 10, 2018 (FR) ..... 18 53105

(51) Int. Cl.
*B07C 3/08* (2006.01)
*B07C 3/06* (2006.01)
*B07C 3/00* (2006.01)

(52) U.S. Cl.
CPC ..... *B07C 3/08* (2013.01); *B07C 3/008* (2013.01); *B07C 3/06* (2013.01)

(58) Field of Classification Search
CPC .. B07C 3/00; B07C 3/06; B07C 3/008; B07C 3/08
USPC ..... 209/509, 606
See application file for complete search history.

(56) References Cited

FOREIGN PATENT DOCUMENTS

| | | |
|---|---|---|
| DE | 199 01 444 C1 | 2/2000 |
| FR | 3 040 900 A1 | 3/2017 |
| WO | 01/12348 A1 | 2/2001 |

*Primary Examiner* — Terrell H Matthews
(74) *Attorney, Agent, or Firm* — Ware, Fressola, Maguire & Barber LLP

(57) ABSTRACT

The sorting installation (1) of the invention for sorting mailpieces (6) includes sorting outlets (2) in line along a sorting conveyor (3), each outlet having a recess (4) for receiving a tray (5) in which sorted mailpieces are stored, and also a tray conveyor (8) that extends under the sorting outlets for transporting the trays filled with sorted mailpieces from the sorting outlets to a feed inlet (7) of the sorting conveyor. The installation of the invention further includes a tray-manipulating shuttle robot (9) suitable for moving along the tray conveyor past the sorting outlets, and for extracting a tray from a recess of a sorting outlet associated with it under the control of a monitoring and control unit (19) so as to transfer it to the tray conveyor.

12 Claims, 2 Drawing Sheets

MAIL SORTING INSTALLATION WITH A TRAY CONVEYOR HAVING A RETRACTABLE EDGE AND ITS TRAY-MANIPULATING SHUTTLE ROBOT

CROSS REFERENCE TO RELATED APPLICATIONS

This application claims priority under 35 USC § 119 to French Patent Application No. 1853105 filed on Apr. 10, 2018, which application is hereby incorporated by reference in its entirety.

TECHNICAL FIELD

The invention relates to the field of sorting mailpieces into trays in postal sorting centers.

The invention relates more particularly to a sorting installation for sorting mailpieces, said sorting installation including sorting outlets in line along a sorting conveyor, each outlet having a recess for receiving a tray in which sorted mailpieces are stored, and also a tray conveyor that extends under said sorting outlets for transporting the trays filled with sorted mailpieces from the sorting outlets to a feed inlet of the sorting conveyor.

PRIOR ART

It is currently known that tray conveyors can be placed under sorting outlets firstly for minimizing the floor area or "footprint" occupied in postal sorting centers and secondly for reducing the transfer distance over which trays have to be transferred from the sorting outlets to the tray conveyor.

That configuration makes it possible for trays to be transferred manually by sorting operatives who retrieve the trays at arms' length from the sorting outlets and then place them on the tray conveyor while orienting them appropriately.

However, the weights and volumes of the trays loaded with mailpieces make handling them awkward and tiring for operatives.

That type of sorting installation is disclosed in particular in Document WO-A-01/12348.

SUMMARY OF THE INVENTION

An object of the invention is thus to remedy the abovementioned problems.

To this end, the invention provides a sorting installation for sorting mailpieces, said sorting installation including sorting outlets in line along a sorting conveyor, each outlet having a recess for receiving a tray in which sorted mailpieces are stored, said sorting installation also including a tray conveyor that extends under said sorting outlets for transporting the trays filled with sorted mailpieces from the sorting outlets to a feed inlet of the sorting conveyor, said sorting installation being characterized in that it further includes a tray-manipulating shuttle robot suitable for moving along the tray conveyor past the sorting outlets, and for extracting a tray from a recess of a sorting outlet associated with it under the control of a monitoring and control unit so as to transfer it to the tray conveyor, said shuttle robot including a chute connected mechanically to the tray conveyor and designed to transfer the tray extracted from the recess to the tray conveyor by the effect of gravity, and in that the tray conveyor includes a pivotally mounted outer edge mounted to pivot between a retracted position allowing the tray to be transferred from the chute to the tray conveyor and a raised position preventing the trays conveyed on the tray conveyor from being ejected from the conveyor while they are being transported towards the feed inlet.

The basic idea of the invention consists in eliminating the operation of transferring trays manually in which sorting operatives transfer trays from the sorting outlets to the tray conveyor, and in using a system that is simple and not motor driven for injecting the tray onto the conveyor.

The idea also consists in preventing the trays from overhanging or from being ejected while they are being transported to the feed inlet, while also temporarily allowing tray transfer to take place from the chute at any point along the tray conveyor by means of the pivotally mounted edge.

The sorting installation of the invention may also have the following features:

- the chute and the pivotally mounted edge are arranged in such a manner that the tray pushes the pivotally mounted edge into the retracted position while the tray is being transferred to the tray conveyor;
- the pivotally mounted edge is provided with return means for bringing the pivotally mounted edge back from the retracted position to the raised position;
- the pivotally mounted edge is segmented into segments that are mounted to pivot independently from one another, and a respective one of said segments extends under each sorting outlet so that the shuttle robot, as controlled by the monitoring and control unit, is suitable for coming to be placed facing both a sorting outlet and a segment of the pivotally mounted edge;
- the tray conveyor includes straight motor-driven conveyor rollers;
- the tray conveyor includes slanting motor-driven conveyor rollers; and
- the tray conveyor includes a fixed outer edge on the side opposite from the pivotally mounted edge.

BRIEF DESCRIPTION OF THE DRAWINGS

The present invention can be better understood and other advantages appear on reading the following detailed description of an embodiment given by way of non-limiting example and with reference to the accompanying drawings, in which.

DESCRIPTION OF THE EMBODIMENT

Figure 1:
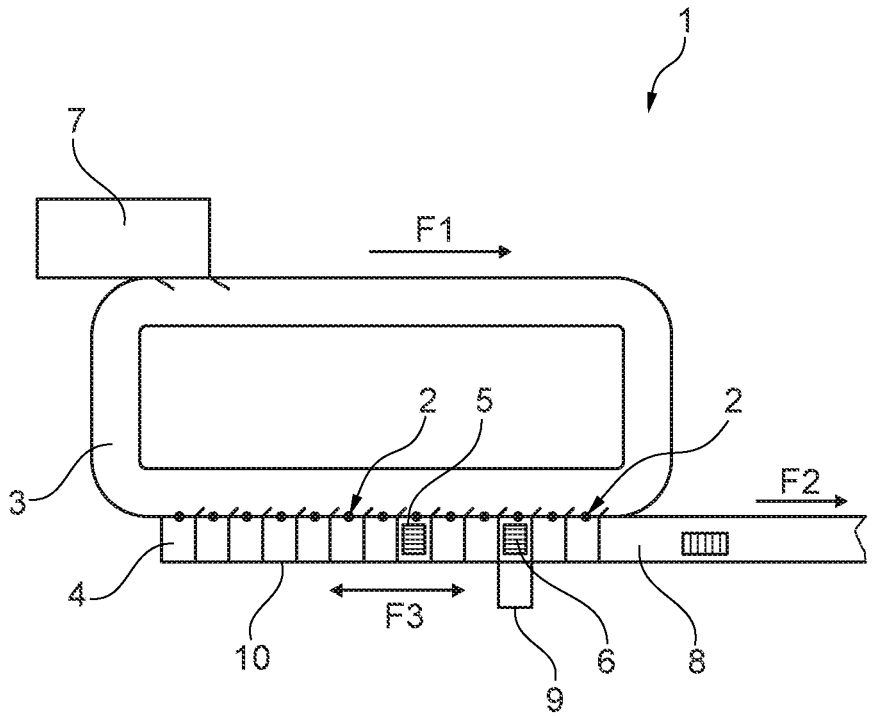
FIG. 1 is a diagrammatic plan view of a sorting installation of the invention.

FIG. 1 shows a sorting installation 1 of the invention that includes sorting outlets 2 in line along a sorting conveyor 3, each outlet having a recess 4 for receiving a tray 5 in which sorted mailpieces 6 are stored.

FIG. 1 also shows a feed inlet 7 designed to put mailpieces 6 in series onto the sorting conveyor 3 for sorting the mailpieces 6 in the conveying direction F1 so that said mailpieces can then be sorted into the corresponding sorting outlets 2.

A tray conveyor 8 is also provided under the sorting outlets 2 for conveying the trays 5 loaded with mailpieces 6 from the sorting outlets 2 to the feed inlet 7 in a conveying direction F2.

In this example, extracting a tray 5 from a recess 4 of a sorting outlet 2 and injecting it onto the tray conveyor 8 under said sorting outlet 2 is performed by means of a shuttle robot 9 suitable for moving autonomously on the floor S1 past the sorting outlets 2 in a movement direction F3 under the control of a monitoring and control unit 19.

Figure 2:
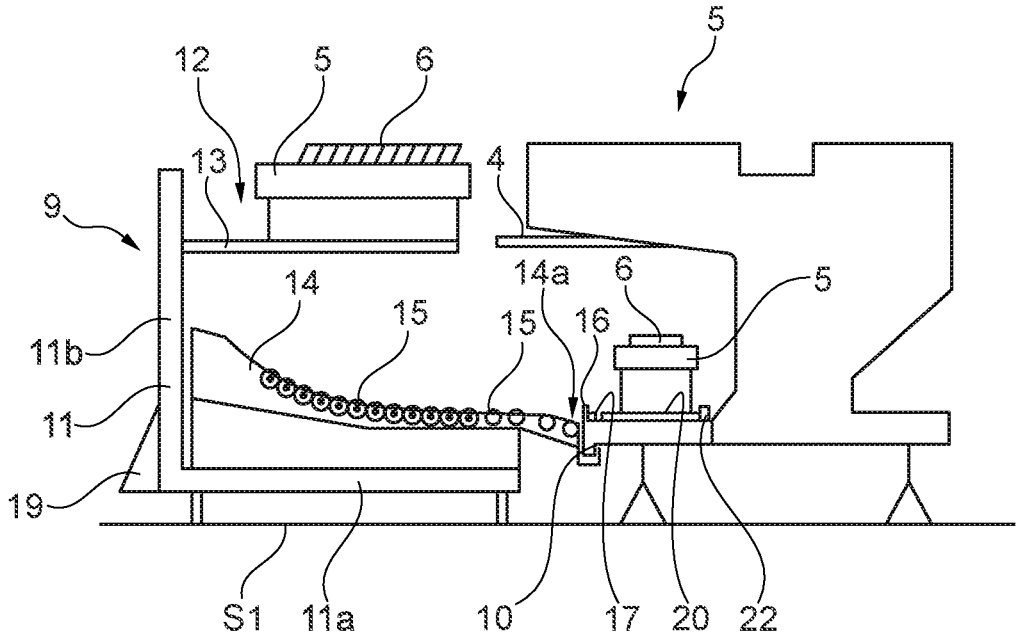
FIG. 2 is a diagrammatic view of the shuttle robot facing a sorting outlet of the sorting installation of the invention.

The shuttle robot 9 connects mechanically to the tray conveyor by hitching up to a guide rail 10 that extends along the entire length of the front face of the tray conveyor 8, as shown in FIGS. 1 and 2.

As shown in FIG. 2, the shuttle robot 9 has a frame 11 that is L-shaped in this example, with a platform 11*a* provided with small wheels, and a back 11*b*, on which tray-handling means 12 are mounted that are suitable for extracting a tray from a recess of a sorting outlet and for placing it on the tray conveyor.

The tray-handling means 12 are provided with a motor-driven pick-up head 13 that is telescopic and movable vertically for the purpose of extracting a tray 5 from the recess 4 of a sorting outlet 2.

The handling means also include a chute 14 for a tray 5, which chute extends under the telescopic head 13 and its low end 14*a* is used to achieve the hitching up to the guide rail 10 in slidable manner.

As shown in FIG. 2, the low end 14*a* of the chute comes flush with the tray conveyor 8 so that each tray 5 can slide directly from the chute onto the conveyor without any manual or motor-driven intervention.

The slope of the chute 14 is thus chosen such that the trays 5 slide by gravity onto the tray conveyor 8.

The chute 14 may also include rollers 15 that are freely rotatably mounted in order to facilitate the sliding of the trays 5 and in order to tolerate smaller gradients for the slope of the chute.

The telescopic pick-up head 13 is also designed to place the tray 5 extracted from the recess 4 of the sorting outlet 2 on the chute 14 for the purpose of injecting it onto the tray conveyor 8.

The tray conveyor 8 further includes a pivotally mounted edge 16 that extends along the tray conveyor on the same side as the side on which the hitching-up of the shuttle robot 9 takes place, as can be seen in FIGS. 2 and 4*a* to 4*c*.

Figure 4A:
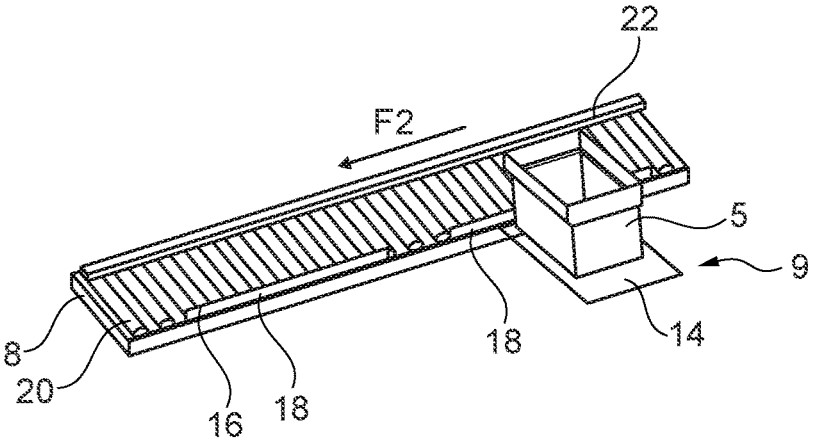
FIGS. 4*a* to 4*c* are diagrammatic views of a tray conveyor of the invention that has straight rollers while a tray is being transferred.
Figure 4B:
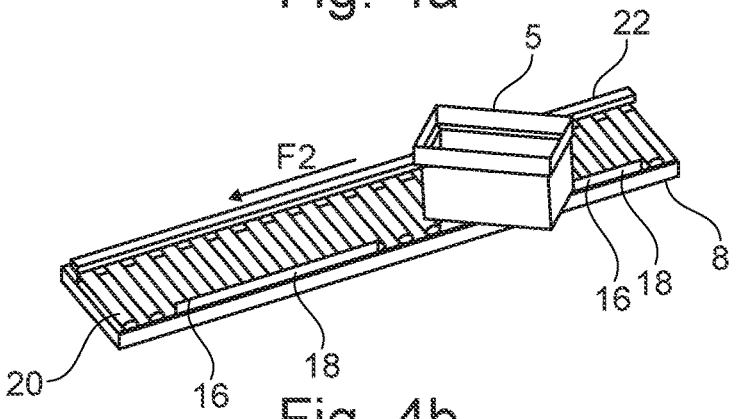
Figure 4C:
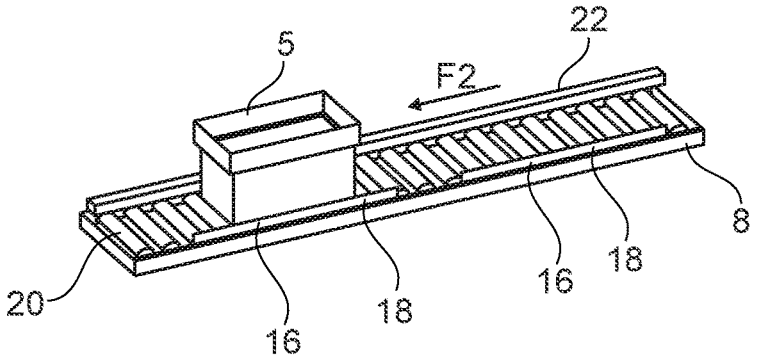

In this example, the edge 16 is mounted to pivot between a retracted position allowing a tray 5 to be transferred from the chute 14 to the tray conveyor 8, as shown in FIG. 4*b*, and a raised position, shown in FIGS. 2, 4*a*, and 4*c*, preventing other trays 5 that are being conveyed on the tray conveyor 8 from being ejected from the conveyor while they are being transported towards the feed inlet 7.

In this example, the low end 14*a* of the chute 14 arrives at the foot of the pivotally mounted outer edge 16 so that, while a tray 5 is being transferred to the tray conveyor 8, the tray 5 pushes the pivotally mounted outer edge 16 into the retracted position under the effect of gravity.

Thus, the pivotally mounted outer edge 16 as retracted finds itself substantially flat on the tray conveyor 8 in order to enable the tray 5 to slide continuously from the chute 14 onto the tray conveyor 8, without modifying, or while modifying only negligibly, the inclination of the tray while it is passing over the pivotally mounted outer edge 16.

Return means 17, e.g. of the return weight or return spring type, and shown in FIG. 2, may also be mounted on the pivotally mounted outer edge 16 so as to bring it back from the retracted position to the raised position when the edge 16 is no longer in contact with the tray 5.

In this example, the return force of the spring is less than the force exerted by the tray while it is being transferred to the tray conveyor.

It can thus be understood that the pivotally mounted edge 16 moving into the retracted position under the action of the tray 5 moving by gravity on the chute 14, and the pivotally mounted edge returning to the raised position by being urged by the return spring 17 enables the pivotally mounted outer edge 16 to be actuated in a manner that is simplified and that is not motor-driven.

The pivotally mounted outer edge 16 may also be segmented into segments 18 that are mounted to pivot independently from one another under each sorting outlet.

In such a situation, the shuttle robot 9 is controlled by the monitoring and control unit 19 in such a manner as to come to be placed both facing a sorting outlet 2 and also facing a segment 18 of edge, as shown in FIG. 4*a*.

In this example, the segmentation into segments 18 makes it possible to allow a segment 18 of edge 16 to pivot facing a sorting outlet that is associated with it, while also keeping the other segments in the raised position so as to prevent trays 5 from being ejected along the tray conveyor.

The tray conveyor 8 of the sorting installation 1 of the invention may also include straight motor-driven conveyor rollers 20, as shown in FIGS. 4*a* to 4*b*, thereby enabling the tray conveyor 8 to be used in a two-directional mode of operation.

Figure 3:
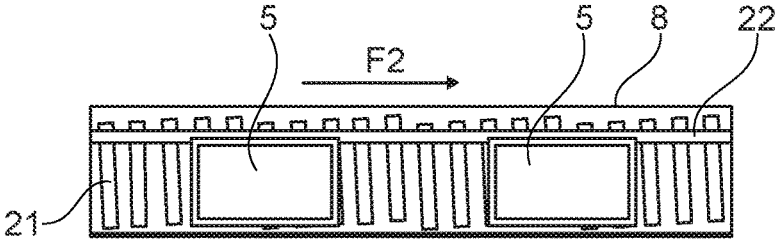
FIG. 3 is a diagrammatic view of a tray conveyor of the invention that has slanting rollers.

In another manner, the tray conveyor 8 may have slanting motor-driven conveyor rollers 21, as shown in FIG. 3, thereby making it possible to use the conveyor 8 in a one-directional mode of operation.

In both situations, a fixed edge 22 on the side opposite from the pivotally mounted outer edge 16 makes it possible to hold the trays 5 while they are traveling towards the feed inlet 7.

Without limiting the scope of the invention, a plurality of shuttle robots 9 may be used on the same guide rail 10 in order to accelerate the rates at which the trays 5 are extracted from and injected onto the tray conveyor 8.

What is claimed is:

1. A sorting installation for sorting mailpieces comprising:

sorting outlets in line along a sorting conveyor, each outlet having a recess for receiving a tray in which sorted mailpieces are stored, a tray conveyor that extends under said sorting outlets for transporting the trays filled with sorted mailpieces from the sorting outlets to a feed inlet of the sorting conveyor, a tray-manipulating shuttle robot suitable for moving along the tray conveyor past said sorting outlets, and for extracting a tray from a recess of a sorting outlet associated with it under the control of a monitoring and control unit so as to transfer it to said tray conveyor, said shuttle robot including a chute connected mechanically to the tray conveyor and configured to transfer said tray extracted from the recess to the tray conveyor by the effect of gravity, and wherein the tray conveyor includes a pivotally mounted outer edge mounted to pivot between a retracted position allowing the tray to be transferred from said chute to the tray conveyor and a raised position preventing the trays conveyed on the tray conveyor from being ejected from the conveyor while they are being transported towards said feed inlet.

2. The sorting installation according to claim 1, wherein said chute and said pivotally mounted edge are arranged in such a manner that the tray pushes the pivotally mounted edge into the retracted position while said tray is being transferred to said tray conveyor.

3. The sorting installation according to claim 2, wherein the pivotally mounted edge is provided with return means for bringing the pivotally mounted edge back from the retracted position to the raised position.

4. The sorting installation according to claim 3, wherein the pivotally mounted edge is segmented into segments that are mounted to pivot independently from one another, and in that a respective one of said segments extends under each sorting outlet so that said shuttle robot, as controlled by the monitoring and control unit, is suitable for coming to be placed facing both a sorting outlet and a segment of the pivotally mounted edge.

5. The sorting installation according to claim 4, wherein the tray conveyor includes straight motor-driven conveyor rollers.

6. The sorting installation according to claim 4, wherein the tray conveyor includes slanting motor-driven conveyor rollers.

7. The sorting installation according to claim 4, wherein the tray conveyor includes a fixed outer edge on the side opposite from said pivotally mounted outer edge.

8. The sorting installation according to claim 1, wherein the pivotally mounted edge is provided with return means for bringing the pivotally mounted edge back from the retracted position to the raised position.

9. The sorting installation according to claim 1, wherein the pivotally mounted edge is segmented into segments that are mounted to pivot independently from one another, and in that a respective one of said segments extends under each sorting outlet so that said shuttle robot, as controlled by the monitoring and control unit, is suitable for coming to be placed facing both a sorting outlet and a segment of the pivotally mounted edge.

10. The sorting installation according to claim 1, wherein the tray conveyor includes straight motor-driven conveyor rollers.

11. The sorting installation according to claim 1, wherein the tray conveyor includes slanting motor-driven conveyor rollers.

12. The sorting installation according to claim 1, wherein the tray conveyor includes a fixed outer edge on the side opposite from said pivotally mounted outer edge.

* * * * *